United States Patent [19]

Swanson

[11] Patent Number: 4,712,833

[45] Date of Patent: Dec. 15, 1987

[54] SEAT CUSHION FOR PREVENTING SLOUCHING OF AN INFANT OR WEAKENED ADULT

[75] Inventor: Elrod H. Swanson, Des Plaines, Ill.

[73] Assignee: Swanson Brothers, Inc., Elk Grove, Ill.

[21] Appl. No.: 919,369

[22] Filed: Oct. 16, 1986

[51] Int. Cl.[4] ..... A47C 31/00

[52] U.S. Cl. ..... 297/219; 5/431; 297/284; 297/423; 297/464

[58] Field of Search ..... 297/219, 423, 284, 464; 5/436, 434, 443, 441, 440, 431

[56] References Cited

U.S. PATENT DOCUMENTS

| | | | |
|---|---|---|---|
| D. 242,388 | 11/1976 | Castleberry | 5/436 X |
| 2,782,839 | 2/1957 | Cole | 297/219 |
| 3,167,351 | 1/1965 | Butler | 297/219 X |
| 3,220,767 | 11/1965 | Hendrickson | 297/219 |
| 3,222,694 | 12/1965 | Schick | 297/219 X |
| 3,311,410 | 3/1967 | Hill | 297/423 |
| 3,753,264 | 8/1973 | Grenier | 5/436 |
| 4,597,605 | 7/1986 | Gilbert | 297/219 |

*Primary Examiner*—Philip C. Kannan
*Attorney, Agent, or Firm*—Charles F. Lind

[57] ABSTRACT

The disclosed seat cushion has a padded member, defining a wedged shape that is pointed rearwardly; and a flexible fabric case encloses such padded member. Ties on the case are used to removably secure the seat cushion to the chair, so that the rear wedged shape of the cushion is located just forwardly of where the seat of the person, sitting on the chair seat, actually makes contact with the chair seat; and the person's legs cross over the seat cushion. The wedge angle may be between 20 and 40 degrees. The case fabric has a high degree of roughness and friction against the clothing of the person that will sit on the chair and over the cushion, such as of a duck or canvas material. The padded member is of a firm foam, to resist being deformed by the weight of the person who will normally be sitting on the cushion, to a dimension less than approximately between 10% and 40% that of the original dimension.

14 Claims, 5 Drawing Figures

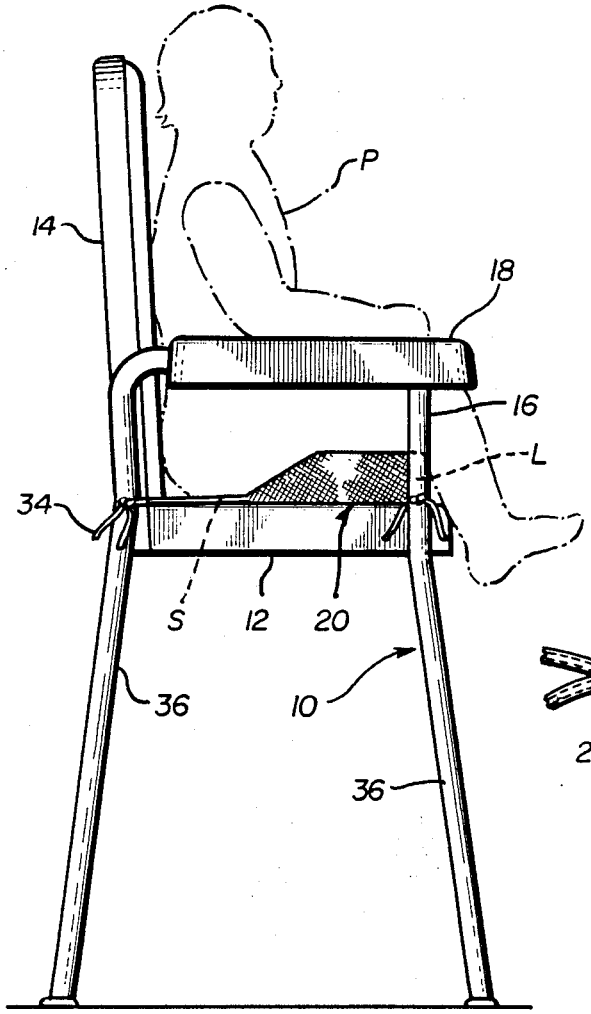
FIG. 1
FIG. 2
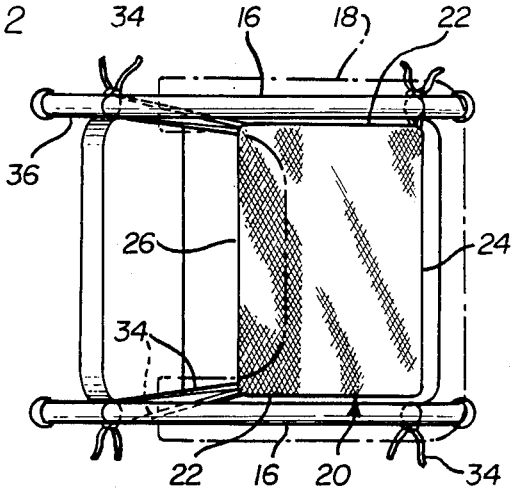
FIG. 3
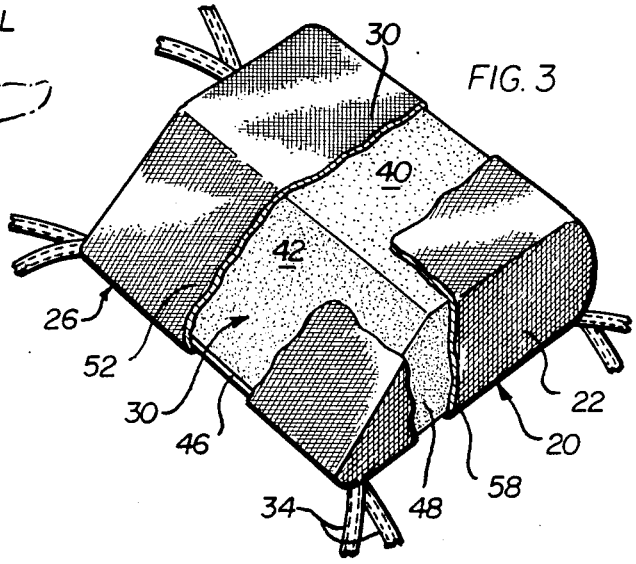
FIG. 5
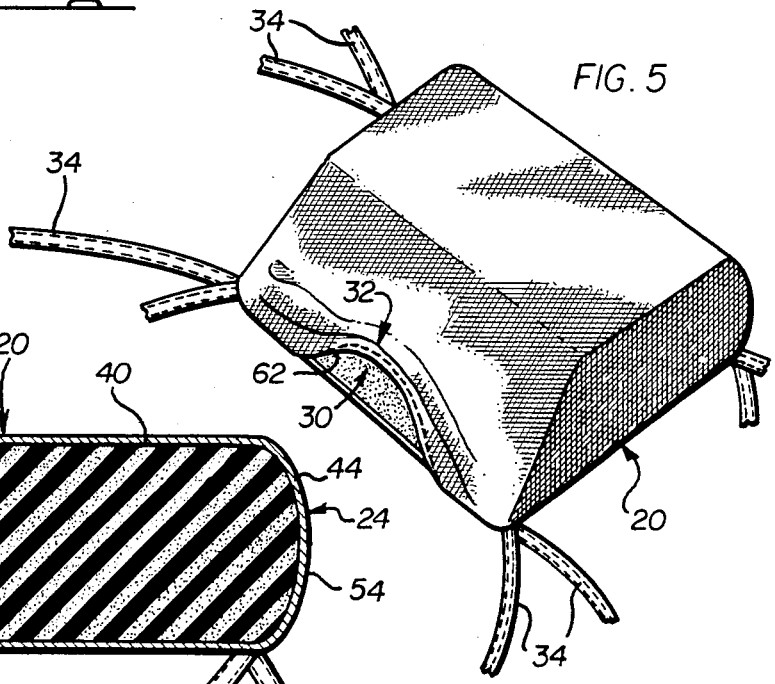
FIG. 4
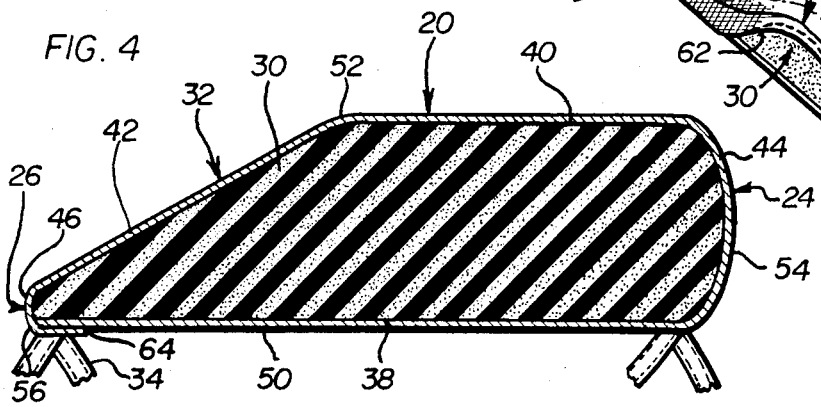

SEAT CUSHION FOR PREVENTING SLOUCHING OF AN INFANT OR WEAKENED ADULT

BACKGROUND OF THE INVENTION

Infants normally begin to sit between the age of three and nine months, and also to use high chairs for eating at this time. Such chairs typically may have a flat seat, a back, and two arm rests or sides. A tray may also be provided, spaced above the seat and forwardly of the back, and the infant's legs fit under the tray.

Because the infant may not be strong enough to sit erect, or may just be squirmy, it is not uncommon for the infant to slide forwardly on the seat, to a slouched position...even to the point of becoming trapped under the tray and/or sliding off the front of the chair. To prevent such, straps may be extended from the chair sides or chair back, and secured around the waist area of the infant.

When sitting erect, the infant may lean forward at the waist to position the head and mouth over the tray. For a very young infant, pillows may be wedged between the infant and the back and/or sides of the chair, to hold the body against the rear of the tray. As so positioned, the mouth is vertically aligned over the tray and it is but a short trip for the food, from a food container on the tray to the mouth. This provides that most food spilled from the eating utensil ends up on the tray for easy cleanup.

On the other hand, the slouched infant orients his/her mouth laterally offset from the tray, so that food dropping off of the eating utensil ends up on the person's lap and not the tray.

The aged or ill, in their weakened condition, also may readily slide on the chair seat to a slouched position, under the eating table or the like, with the same drawbacks as mentioned above concerning an infant.

SUMMARY OF THE INVENTION

The present invention provides a seat cushion that can be placed on and removably secured relative to a chair seat, that prevents a person who may sit on the chair seat and cushion, from sliding forwardly of the chair seat, to end up in a slouched position.

The seat cushion has a padded member, defining a bottom and a top, and side edges extended therebetween. The top of the padded member has a portion that is angled relative to the bottom, defining with the bottom a wedge portion having its apex pointing toward the rear edge. Means removably hold the padded member relative to the chair seat. A person may sit with his/her seat rearwardly of the wedge portion and with the wedge portion pointing toward his/her seat, and with his/her legs over the wedge portion and remainer of the seat cushion forward of the wedge portion.

The wedge portion may define an angle between 20 and 40 degrees.

The padded member may fit in a case made of a flexible durable fabric, such as duck or canvas material. Ties on the case may removably secure such case to the chair, to removably hold the padded member relative to the chair seat. The case fabric may generate a high degree of friction against the clothing of the person that will sit on the cushion.

The padded member may be firm enough to resist deforming under the weight of the person sitting on the cushion, to maintain the configuration of the wedge portion; the compressed dimension being approximately between only 10% and 40% that of the original or non-compressed dimension.

BRIEF DESCRIPTION OF THE DRAWINGS

FIG. 1 is a side elevational view of a typical chair showing one embodiment of the inventive seat cushion operationally in place on the chair seat, and showing (in phantom only) a person sitting on the chair seat and cooperating with the seat cushion;

FIG. 2 is a top plan view of the seat and cushion of FIG. 1;

FIG. 3 is a perspective view of the seat cushion of the previous figures, showing the case partially broken away for greater clarity of disclosure;

FIG. 4 is an enlarged sectional view; similar to FIG. 1, showing additional details of the seat cushion; and FIG. 5 is a perspective view, similar to FIG. 3, showing the case partially opened for greater clarity of disclosure.

DETAILED DESCRIPTION OF AN ILLUSTRATED EMBODIMENT

FIGS. 1 and 2 show a chair 10 that has a seat 12, a back 14, two side arms 16, and a tray 18 spaced above the seat and forwardly of the back. A seat cushion 20 formed according to this invention is illustrated secured on and relative to the chair seat 12. A person P (shown only in phantom) is shown sitting in the chair 10, with the seat cushion 20 underlying part of the legs L and seat S of the person.

The seat cushion 20 is smaller than the chair seat 12, but is sufficiently wide between the two sides 22 to underlie most of the width of the legs L and/or seat S of the person P that will sit on the chair. The seat cushion 20 is also sufficiently deep between front side 24 and rear side 26 to underlie part of the length of the legs L of the person P that will sit on the chair.

The seat cushion 20 has a padded member 30 and a flexible case or cover 32 designed to fit over and enclose the padded member 30. Flexible ties or straps 34 are on the case 32, in pairs at the four corners of the seat cushion 20; and each pair is sufficiently long to be looped around chair legs 36 next to or under the seat 12, or around framing structure for the chair back 14 or chair side arms 16, and be tied or otherwise fastened together, so as to removably secure the seat cushion 20 relative to the chair seat 12 of the chair 10.

The padded member 30 is shaped to define a generally flat bottom 38, a top having a forward portion 40 and rearward portion 42; and front side edge 44, rear side edge 46 and opposite side edges 48 are extended therebetween. The case 32 is contoured to have bottom panel 50, top panel 52, and fron, rear and opposite side panels (54, 56 and 58) corresponding respectively to the bottom and top faces, and front, rear and side edges (44, 46 and 48) respectively of the padded member 30.

An access opening 62 for the padded member 30 is provided in the case 32 along the bottom rear portion thereof across the full width between the side panels 58. A lap panel 64 is formed off of the lower end of the rear panel 56, to extend along and overlap the bottom panel 50 at the rearward edge, for closing the access opening 62 and hiding the padded member 30 in the case; while not requiring any fastening means such as a zipper or snaps, that may scratch the chair seat 12.

The top forward portion 40 of the padded member 30 is generally flat, and is substantially parallel to the bottom 38 of the member. The rearward portion 42 of the padded member 30 is angled relative to both the top forward portion 40 and to the bottom 38 of the member, and defines with the member bottom, a rearwardly pointing wedge-like portion or configuration having its apex generally pointing toward or being at the rear side edge 46. The wedge configuration may be at an angle of between 20 and 40 degrees. The top forward and rearward portions 40 and 42 of said padded member 30 meet approximately midway between the front and rear edges 44 and 46 of the member.

The case 32 may be made of a flexible durable fabric that will have a relatively high degree of roughness and friction, as between the clothing of the person P who will sit on the chair 10 and over the seat cushion 20. The material may be of a natural or synthetic fiber, and/or a blend of both. Several preferred case fabrics may be a duck or canvas material, or a cotton polyester blend. In a preferred construction, the case fabric will be surface treated to be water and dirt repellant.

Depending on the size of the person P who will be using the seat cushion 20, its size in general and the height of the front side edge 44 in particular, as well as its firmness, each may vary somewhat. It would be contemplated that several versions of the seat cushion be provided to accomodate the full range of sizes and weights of potential users.

When the seat cushion 20 is intended to be used by an infant, the front side edge 44 may be between 2 and 4 inches high; while when an adult or larger person may be expected to use the seat cushion, the front edge may be between 2 and possibly 5 inches high. The rear side edge 46 may generally be less than 1 inch high, and possibly as little as ¼ or ½ of an inch high, for use with either an infant or an adult. When the seat cushion 20 is intended to be used by an infant, it may be between 8 and 14 inches wide, and between 7 and 12 inches deep; and when the seat cushion 20 is intended to be used by an adult, it may be between 12 and 18 inches wide, and between 8 and 13 inches deep.

The padded member 30 may be made of a foam, having a firm body and fixed dimensions when not being compressed. It is contemplated that the padded member 30 may have a firmness to withstand the weight of the person P who will normally sit on the cushion, and yet not deform to a dimension any less than approximately between 10% and 40% of the original or non-compressed dimension, to maintain the wedge configuration of the cushion. With a light infant, the cushion material can be relatively soft; while with a heavier person or adult, the cushion material need be firmer. It is possible that a seat cushion intended for an adult may seem incompressible, although workable, when used by a small infant.

A polyurethane or polyether foam, having a density of approximately 1 pound per cubic foot and having an Indention Force Deflection (or Inner Load Deflection) of approximately 30–40 pounds, has been found adequate for a small person, or infant. A polyurethane or polyether foam, loaded with a clay base and having a density of approximately 2–3 pounds per cubic foot and having an IFD (or ILD) of approximately 50–80 pounds, as been found adequate for a large person, or adult.

Concerning the use of the seat cushion 20 and as illustrated in FIG. 1, the seat cushion may be placed on and secured relative to the chair seat 12, somewhat forwardly of the chair back 14, to locate the wedge portion forwardly of the person's seat S. This allows that some of the chair seat 12 may be exposed, and the person's seat S may actually be against the chair seat 12. The rear part of the person's legs L cross the seat cushion 20; and the person's seat S is on the down side and rearwardly of the wedged configuration, and will not ride up the wedge because of its firmness and because of the relatively high friction against the person's clothing. Normal squiring of the person P normally will still not allow the person's seat S to ride up the wedged seat, thus keeping the person from sliding forward relative to the chair seat 12 to a slouched position.

Once the seat cushion 20 has been secured relative to the chair seat 12, the person P need only be put on the chair seat and over the seat cushion, without securing any lap straps or the like around the person, in order to prevent the person from slouching forward on the chair seat. Pillows (not shown) may be wedged between the chair back and/or chair arms, and the person, for even greater support of the person and/or cause the person to lean forward.

Further objects, advantages and features of the present invention may be appreciated from a study of the drawing, the specification and the following claims.

What is claimed as my invention is:

1. For use with a chair having a seat with spaced forward and rearward edges, an improved cushion adapted to be removably secured to the chair so as to cover most of the seat, said cushion comprising the combination of a padded member having a bottom and a top, and having front, rear and opposed side edges extended therebetween;

the bottom of said padded member being generally flat; and the top of said padded member having generally flat forward and rearward portions meeting between the front and rear edges, and being angled relative to one another;

the angled rearward top portion of the padded member further being angled relative to the bottom of the padded member, to define a wedge configuration pointing rearwardly toward, and having an apex at, the rear edge thereof;

said padded member between the said front and rear edges being only slightly smaller than the chair seat between the said forward and rearward edges, and being sufficiently wide between the two side edges to extend beyond and underlie the legs and/or seat area of the person who will sit on the chair seat;

means to removably hold the padded member on and secured relative to a chair seat: with the wedge configuration pointing rearwardly toward, but being only slightly spaced forwardly of, the rearward edge of the chair seat; and with the front edge located even with or only slightly rearwardly of the forward edge of the chair seat;

so that a person may sit on the chair seat: with his/her seat area disposed closely adjacent the rearward edge of the chair seat, to be seated erect, and with his/her seat area disposed just rearwardly of and/or on the wedge configuration of the padded member; and with the forward portion of his/her seat area and part of his/her legs between the knees and seat area crossing over the rearward and forward top portions of the cushion; and the padded member having a firmness to withstand the weight of the person who will normally sit on the cushion and yet deform, but not to a dimension less than between approximately 10% and 40% that of the original dimension.

2. A seat cushion as claimed in claim 1, further wherein the padded member between the side edges is between 8 and 18 inches wide, and wherein the padded member between the front and rear edges is between 7 and 13 inches deep; and the front edge is between 2 and 5 inches high, and the rear edge is less than 1 inch high.

3. A seat cushion as claimed in claim 1, further wherein the padded member is of foam material having a density between 1 and 3 pounds per cubic foot and an Indention Force Deflection value between 30 and 80 pounds.

4. A seat cushion as claimed in claim 3, further wherein the top forward and rearward portions of said padded member meet approximately midway between the front and rear edges.

5. A seat cushion as claimed in claim 1, further wherein said means to removably hold the padded member relative to the chair seat includes a flexible case enclosing such member; and flexible ties on the case that may be removably secured to the chair, to hold the case fixed relative to the chair seat.

6. A seat cushion as claimed in claim 5, further wherein said case is contoured to have overlapping bottom, top and side panels corresponding to the bottom, the top and the side edges respectively, of the padded member; and wherein an access opening for the padded member is provided in the case along the bottom and rear thereof, between the overlapping bottom panels adjacent rear side panel.

7. A seat cushion as claimed in claim 6, further wherein the case is made of a flexible durable fabric that has a relatively high degree of roughness and friction, as against the clothing of the person who will sit on the chair and over the cushion.

8. A seat cushion as claimed in claim 7, further wherein said top rearward portion of the padded member as angled relative to the bottom defines said wedge configuration between 20 and 40 degrees; and the padded member between the side edges is between 8 and 18 inches wide, and wherein the padded member between the front and rear edges is between 7 and 13 inches deep; and the front edge is between 2 and 5 inches high, and the rear edge is less than 1 inch high.

9. For use with a chair having a seat with spaced forward and rearward edges, an improved cushion adapted to be removably secured to the chair so as to cover most of the seat, said cushion comprising the combination of a padded member having a bottom and a top, and having front, rear and opposed side edges extended therebetween;

the bottom of said padded member being generally flat; and the top of said padded member having generally flat forward and rearward portions meeting between the front and rear edges, and being angled relative to one another;

the angled rearward top portion of the padded member further being angled relative to the bottom of the padded member, to define a wedge configuration pointing rearwardly toward, and having an apex at, the rear edge thereof;

said padded member between the said front and rear edges being only slightly smaller than the chair seat between the said forward and rearward edges, and being sufficiently wide between the two side edges to extend beyond and underlie the legs and/or seat area of the person who will sit on the chair seat;

a flexible case enclosing such padded member;

ties on the case adapted to be removably secured to the chair to removably hold the case and the padded member therein on and secured relative to the chair seat: with the wedge configuration pointing rearwardly toward, but being only slightly spaced forwardly of, the rearward edge of the chair seat; and with the front edge located even with or only slightly rearwardly of the forward edge of the chair seat;

so that a person ma sit on the chair seat: with his/her seat area disposed closely adjacent the rearward edge of the chair seat, to be seated erect, and with his/her seat area disposed just rearwardly of and/or on the wedge configuration of the padded member; and with the forward portion of his/her seat area and part of his/her legs between the knees and seat area crossing over the rearward and forward top portions of the cushion;

the case being of a flexible durable fabric that has a relatively high degree of roughness and friction, as against the clothing of the person that will sit on the chair and over the cushion; and the padded member being of foam material having a density between 1 and 3 pounds per cubic foot and an Indention Force Deflection value between 30 and 80 pounds, sufficient to withstand the weight of the person who will normally sit on the cushion and yet deform but to a dimension not less than between approximately 10% and 40% that of the original dimension.

10. A seat cushion as claimed in claim 9, further wherein the padded member between the side edges is between 8 and 18 inches wide, and wherein the padded member between the front and rear edges is between 7 and 13 inches deep; and the front edge is between 2 and 5 inches high, and the rear edge is less than 1 inch high.

11. A seat cushion as claimed in claim 9, further wherein said case is contoured to have overlapping bottom, top and side panels corresponding to the bottom, the top and the side edges respectively, of the padded member; and wherein an access opening for the padded member is provided in the case along the bottom and rear thereof, between the overlapping bottom panels adjacent rear side panel.

12. A seat cushion as claimed in claim 11, further wherein the rearward top portion and the bottom of the padded member are angled at said wedge configuration between 20 and 40 degrees.

13. A seat cushion as claimed in claim 11, further wherein the padded member between the side edges is between 8 and 18 inches wide, and wherein the padded member between the front and rear edges is between 7 and 13 inches deep; and the front edge is between 2 and 5 inches high, and the rear edge is less than 1 inch high.

14. A seat cushion as claimed in claim 13, further wherein said top rearward portion of the padded member and the bottom of the padded member are angled at said wedge configuration between 20 and 40 degrees.

* * * * *